US007250837B2

(12) United States Patent
Nielson et al.

(10) Patent No.: US 7,250,837 B2
(45) Date of Patent: Jul. 31, 2007

(54) ELECTRO-MECHANICAL MICRO-SWITCH DEVICE

(75) Inventors: Gregory N. Nielson, Albuquerque, NM (US); George Barbastathis, Boston, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 10/979,706

(22) Filed: Nov. 2, 2004

(65) Prior Publication Data

US 2005/0173235 A1 Aug. 11, 2005

Related U.S. Application Data

(60) Provisional application No. 60/533,128, filed on Dec. 30, 2003.

(51) Int. Cl.
*H01H 51/22* (2006.01)

(52) U.S. Cl. ..... 335/78; 200/181

(58) Field of Classification Search ..... 335/78; 361/232–233; 200/181
See application file for complete search history.

(56) References Cited

U.S. PATENT DOCUMENTS

| | | | | |
|---|---|---|---|---|
| 5,096,279 | A | 3/1992 | Hornbeck et al. | |
| 6,218,911 | B1 | 4/2001 | Kong et al. | |
| 6,897,537 | B2 * | 5/2005 | de los Santos | 257/414 |
| 2003/0090346 | A1 | 5/2003 | Nikitin | |
| 2003/0155995 | A1 | 8/2003 | Iwata et al. | |
| 2003/0178913 | A1 | 9/2003 | Norimatsu | |
| 2003/0218283 | A1 * | 11/2003 | Yasumura et al. | 267/136 |
| 2005/0006738 | A1 * | 1/2005 | Schaper et al. | 257/678 |

FOREIGN PATENT DOCUMENTS

| | | |
|---|---|---|
| EP | 1 146 532 A | 10/2001 |
| EP | 1 257 149 A | 11/2002 |
| WO | 02/23606 A | 3/2002 |
| WO | 02/058089 | 7/2002 |

OTHER PUBLICATIONS

"Electromechanical Considerations in developing Low-Voltage RF MEMS Switches," Peroulis et al., *IEEE Transactions on Microwave Theory and Techniques,* vol. 51, n. 1 (Jan. 2003).

"Integrated RF-MEMS Switch Based on a Combination of Thermal and Electrostatic Actuation," Robert et al., *Int'l. Conference on Solid State Sensors, Actuators and Microsystems,* Boston (Jun. 8-12, 2003).

International Search Report and Written Opinion for PCT/US2004/036357, Apr. 15, 2005, 14 pages.

* cited by examiner

*Primary Examiner*—Elvin Enad
*Assistant Examiner*—Bernard Rojas
(74) *Attorney, Agent, or Firm*—Goodwin Procter LLP

(57) ABSTRACT

The electro-mechanical micro-switch device includes first and second fixed electrodes. A movable electrode is positioned with respect to the first and second fixed electrodes so that the position of the movable electrode can be selectively placed in one of two opposing states defined by the fixed electrodes. The stored elastic potential energy of the movable electrode and its flexible supporting structure is used for switching between the two states. An electrostatic hold voltage is used to hold the movable electrode in the two switch states.

8 Claims, 9 Drawing Sheets

ELECTRO-MECHANICAL MICRO-SWITCH DEVICE

PRIORITY INFORMATION

This application claims priority to U.S. Provisional Patent Application No. 60/533,128, filed Dec. 30, 2003 which is incorporated herein by reference in its entirety.

BACKGROUND OF THE INVENTION

The invention relates to the field of micro-electro-mechanical systems (MEMS), and in particular to MEMS using stored elastic potential energy for actuation in both switching directions, with the switch trigger provided by electrostatic forces.

In MEMS parallel plate and torsional actuators, the pull-in phenomenon has been effectively utilized as a switching mechanism for a number of applications. Pull-in is the term that describes the snapping together of parallel plate actuators due to a bifurcation point that arises from the nonlinearities of the system. Micro-electro-mechanical system (MEMS) switches based on parallel plate electrostatic actuators have demonstrated impressive performance in applications such as RF and low frequency electronic switching as well as optical switching.

However, these devices have not yet become significantly commercialized. One of the reasons for this is that these switches tend to have operating voltages higher than what is normally available from an integrated circuit. Voltage up-converters are therefore necessary for these devices to operate in a commercial application which adds cost, complexity, and power consumption. The high operating voltages are a result of the actuating voltage needing to exceed the high pull-in voltage of the parallel plate and torsional actuators. While some electrostatic MEMS switches have been designed for low (10-20V) pull-in (and actuation) voltages by decreasing the structure stiffness, this has so far only been done with a significant sacrifice in reliability and performance. There are other actuation techniques, such as thermal or magnetic, that operate with lower voltages, however these are significantly slower than electrostatic switches and also consume much more power.

SUMMARY OF THE INVENTION

According to one aspect of the invention, there is provided an electro-mechanical micro-switch device. The emectro-mechanical micro-switch device includes first and second electrodes. A movable electrode, supported by a support structure, is positioned with respect to the first and second electrodes so that the position of the movable electrode can be selectively placed in one of two opposing states defined by the first and second electrodes under application of a voltage with respect to one of the first or second electrodes. A pull-in voltage is defined for the device. The movable electrode and its support structure are part of a flexible structure and wherein elastic potential energy stored in the flexible structure is used for switching between the two states so that the movable electrode can switch under application of a voltage lower then the pull-in voltage.

According to another aspect of the invention, there is provided a method of forming an emectro-mechanical micro-switch device. The method includes providing first and second electrodes. Also, the method includes providing a movable electrode that is positioned with respect to the first and second electrodes so that the position of the movable electrode can be selectively placed in one of two opposing states defined by the first and second electrodes. The stored elastic potential energy of the movable electrode and its flexible supporting structure is used for switching between the two states.

DETAILED DESCRIPTION OF THE INVENTION

The emectro-mechanical micro-switch device of the invention provides a switching mechanism that can be used in a variety of switching applications including; an optical switch, a radio frequency circuit switch (RF MEMS switch), and a micro-mechanical relay. The structure provides basic mechanical switch functionality, that is, the position of the moving portion of the structure can be selectively placed in one of two states.

Figure 1A:
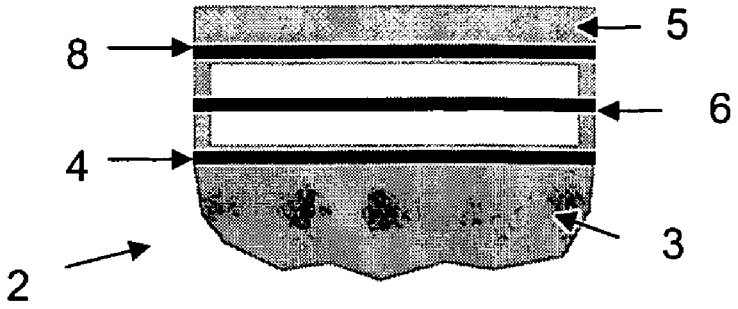
FIGS. 1A-1C are schematic block diagrams illustrating the operation of the inventive emectro-mechanical micro-switch device.
Figure 1B:
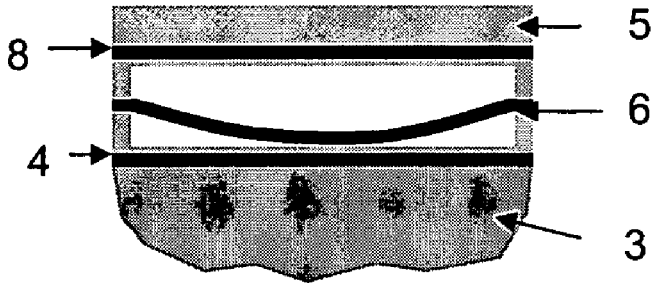
Figure 1C:
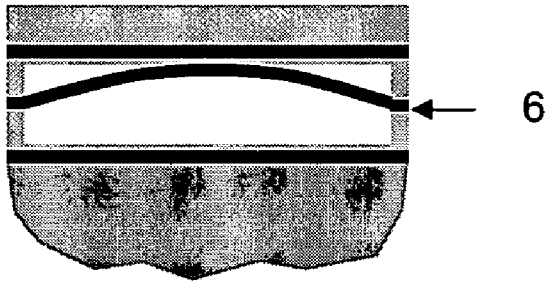

The invention uses a new approach for the switching actuation. The switch uses stored elastic potential energy for switching both directions, i.e., on and off. An exemplary embodiment of a switch 2 structure in accordance with the invention is shown in FIG. 1A. The switch 2 includes a fixed bottom electrode 4, a movable middle electrode 6, and a fixed top electrode 8. The movable middle electrode 6 can be switched from being pulled-in to the bottom electrode 4 to being pulled-in to the top electrode 8, and vice-versa, as shown in FIGS. 1B and 1C. There is a third equilibrium position for the middle electrode 6 in between the top 8 and bottom electrode 4, as shown in FIG. 1A. This position could potentially be used for a three way switch, but it would introduce slower switching speeds and require higher actuation power due to the stored elastic potential energy in the structure needing to be dissipated and reinserted into the system to move into and out of the third equilibrium position. The bottom electrode 4 is formed on the substrate material 3, and the top electrode 8 is supported by a thick layer of a supporting material (e.g., silicon oxide) so it does not move. Electrically isolating layers comprised of a non-conducting material are necessary in between the movable electrode and the first and second fixed electrodes. Typically this would be a material such as silicon oxide or silicon nitride but in some implementations this could also be a free-space gap that is achieved due to the geometry of the switching structure.

Figure 2:
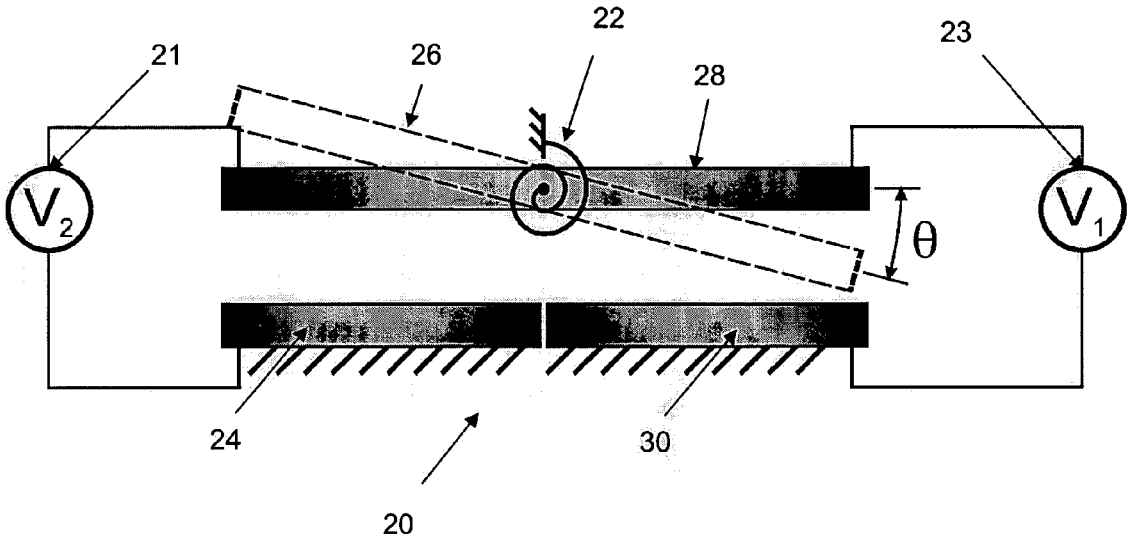
FIG. 2 is a schematic block diagram illustrating another embodiment of the inventive emectro-mechanical micro-switch device.

Another exemplary embodiment of this switch would be a movable electrode that experiences rotational motion between two fixed electrode positions, as shown in FIG. 2. The movable electrode 28 is suspended by a torsional spring 22 rather than a translational spring. This structure would allow the two opposing fixed electrodes 24, 30 to be located on the same fabrication level. The movable electrode 28 displaces in the direction defined by θ. One possible displaced position of the movable electrode 28 is shown by the dashed outline 26 where the rotation of the movable electrode 28 is towards the fixed electrode 30. The plate can also rotate in the opposite direction towards the fixed electrode 24. Voltage potentials 21, 23 are applied between the fixed electrodes 24, 30 and the movable electrode 28. Although they are not shown in FIG. 2, isolation layers between the two fixed electrodes 24, 30 and the movable electrode 28 are required. The actuation principle is the same as in the case of the switch structure 2 illustrated in FIG. 1, that is, the energy for switching comes from stored elastic potential energy.

Figure 3:
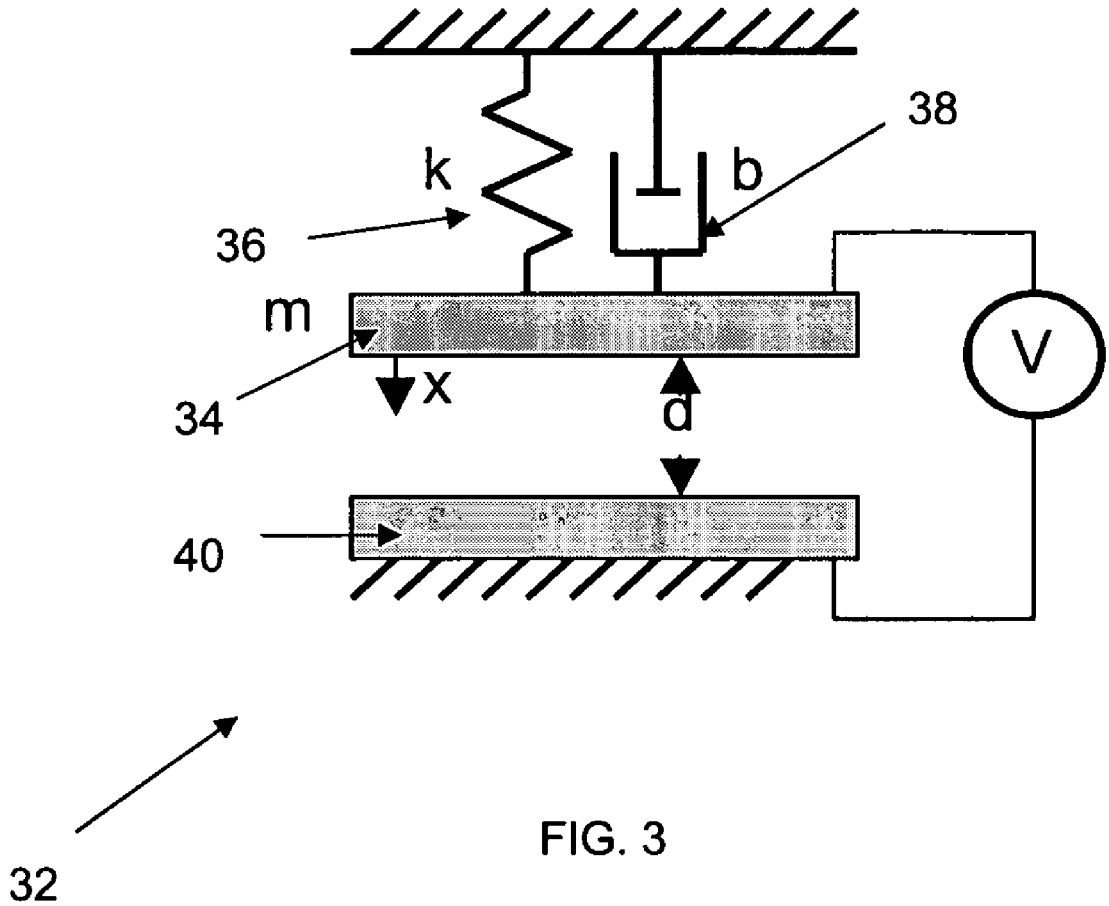
FIG. 3 is a schematic block diagram illustrating a parallel plate electrostatic actuator model.

Although the switch 2 or 20 uses stored elastic potential energy for switching, the trigger for the switch 2 or 20 utilizes electrostatics. The idea of electrostatic actuation has been used in many MEMS applications. The switch 2 or 20 of the invention uses electrostatic force in a new way to selectively hold and release the structure. The best way to describe the electrostatic nature of the switch is by first looking at the typical model 32 of a parallel plate electrostatic actuator, as shown in FIG. 3.

The model 30 is composed of a movable electrode 34 suspended by a spring 36 and damper 38 above a fixed electrode 40. A voltage potential V is applied between the movable electrode 34 and the fixed electrode 40. The equation of motion for the parallel plate actuator model is $$m\ddot{x} + b\dot{x} + kx = \frac{\varepsilon A V^2}{2(d_0 - x)^2} \tag{1}$$

where ϵ is the permittivity of the gap, A is the area of the plates, V is the voltage difference applied between the fixed 40 and movable 34 electrodes, and $d_0$ is the initial gap between the electrodes 34, 40.

Figure 4:
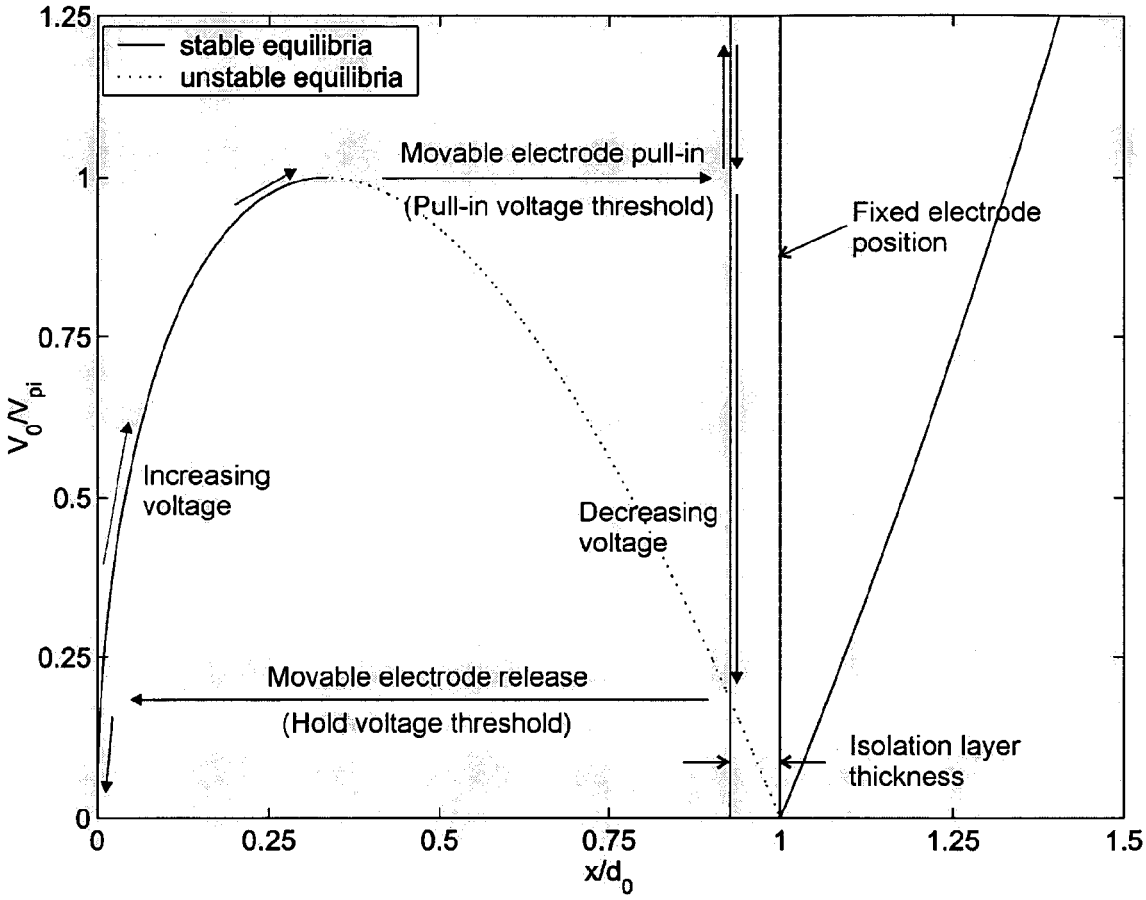
FIG. 4 is a graph illustrating the voltage versus displacement curve for the parallel plate actuator in quasi-static operation.

For the quasi-static case ($\ddot{x} \approx \dot{e} \approx 0$), the relationship between the voltage and displacement, x, is shown in FIG. 4. In FIG. 4, the applied voltage is normalized with the pull-in voltage ($V/V_{pi}$), and the displacement is normalized with the initial gap ($x/d_0$). Although all points on the graph are equilibrium positions, the points on the curve within ($0 \leqq x/d_0 < 1/3$) and ($x/d_0 \geqq 1$) are stable equilibria while the points on the curve within ($1/3 \leqq x/d_0 < 1$) are unstable equilibria. When a voltage is applied to the electrostatic actuator, the displacement of the movable structure will initially follow the curve while it is in the first stable equilibria region ($0 \leqq x/d_0 < 1/3$). Once the pull-in voltage ($V/v_{pi}=1$) and position ($x/d_0=1/3$) is reached, the movable electrode will want to jump to the second stable equilibria region ($x/d_0 \geqq 1$). Because of the position of the fixed electrode and the isolation layer in between the movable and fixed electrodes, the movable electrode will not actually reach the second stable equilibria region of the curve but instead will be held against the isolation layer. This effect is called pull-in.

When the voltage is decreased, the movable electrode will not be released from its pulled-in state until the point defined by its position and the applied voltage falls to the left of the unstable equilibrium curve. The voltage at which the movable electrode is released is called the hold voltage. The pull-in and hold voltages are both illustrated in FIG. 4. It can also be seen from FIG. 4 that the hold voltage is a fraction of the pull-in voltage and that the magnitude of that fraction is defined by the thickness of the isolation layer in between the movable and fixed electrodes. In practice, the hold voltage can be less than 5% of the pull-in voltage.

In operation, the movable structure 6 or 28 of the switch described in FIG. 1 and FIG. 2 respectively is either pulled-in to one of the two fixed electrodes, or moving between them. To trigger the switching of the structure 6 or 28 from one electrode to the other, the voltage applied to the electrode (e.g., 4 or 24) that is initially pulling in the structure 6 or 28 is turned off and a voltage is applied to the other fixed electrode (e.g., 8 or 30) either before, at the same time, or shortly after the first voltage is turned off. When this happens, the stored elastic potential energy in the structure 6 or 28 and/or in their flexible supporting structures causes the structure 6 or 28 to swing towards the second fixed electrode. If the damping in the system is minimized, the movable electrode 6 or 28 will come very close to the second electrode which allows the second electrode to catch, or pull-in, the moving electrode 6 or 28 at a voltage that is much smaller than the pull-in voltage. The operation to switch in the reverse direction is identical.

By using the stored elastic potential energy in the system to move the switch from one fixed (pulled-in) position to the next, the high pull-in voltage required by standard parallel plate and torsional electrostatic actuators is avoided. The voltage required for switching is at or slightly above the electrostatic hold voltage level. The damping and degree of symmetry in the system determines how much higher the actuation voltage needs to be above the electrostatic hold voltage. The electrostatic hold voltage is set by the geometry of the switch with the isolation layer playing a particularly important role, as shown in FIG. 4. The hold voltage level can be designed to be only a few percent of the pull-in voltage level, perhaps even less, or, alternatively, can be designed to be essentially the same as the pull-in voltage level. The actuation voltage can therefore be preferably set from very low voltage levels (i.e. 3 volts) to rather high voltage levels (i.e. 100 volts) depending on the requirements of the particular application. This range of voltages is primarily achieved by adjusting the thickness of the isolation layer, rather than the mechanical stiffness. This means that at even very low operating voltage levels, the switch technique should still allow for fast and reliable actuation, unlike standard parallel plate and torsional electrostatic switches.

Figure 5:
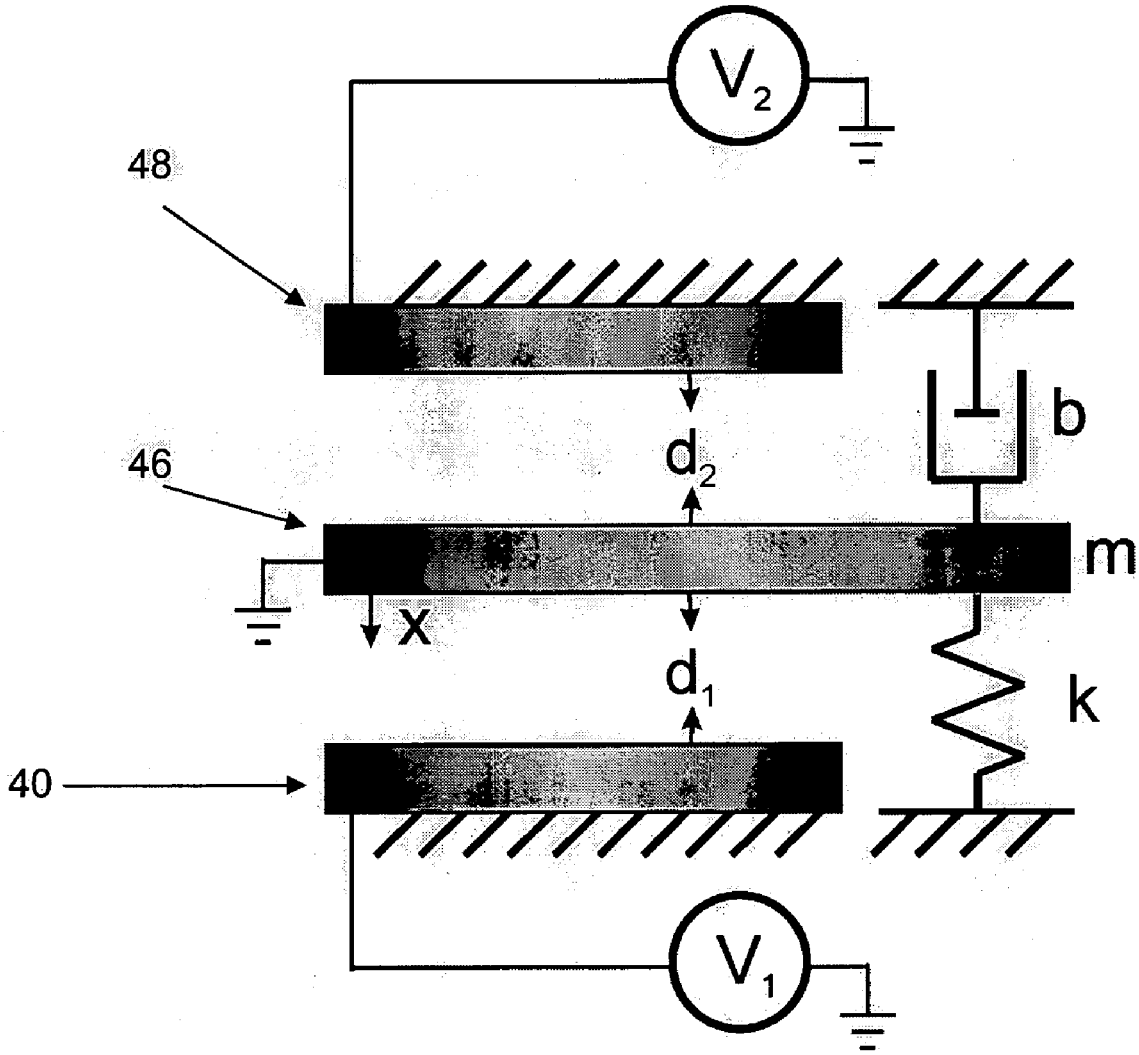
FIG. 5 is a schematic block diagram of a lumped parameter model of a parallel plate embodiment of the inventive emectro-mechanical micro-switch device (see FIGS. 1A-1C)

For optimal operation of the switch, the mechanical damping should be minimized and the symmetry of the structure about the un-actuated (i.e. no applied voltage) equilibrium position of the movable electrode should be maximized. The smaller the damping, the more the stored elastic potential energy is directed to the switching operation. Similarly, the symmetry of the device affects how much of the energy for switching comes from the stored elastic potential energy, as opposed to electrostatic energy. While non-symmetric embodiments would still function, ideal operation requires that the device be exactly symmetrical, for example in FIG. 5, the initial gaps between the movable 46 and fixed electrodes 40, 48, $d_1$ and $d_2$, should be equal. However, some applications of the inventive micro-switch may need to sacrifice symmetry and performance for the functional requirements of the application.

Since the maximum voltage needed for this switch is potentially less than 5% of the pull-in voltage, the stiffness of the structure can be increased significantly compared to a switch that uses standard electrostatic actuation. This increases the resonant frequency of the moving structure and decreases the switching time, which can be significantly lower than standard electrostatic switches. The standard approach to electrostatic switches had, previous to this new approach, been the fastest mechanical switch technology.

To achieve the low damping (or high Q) needed for the switch, it may be necessary to operate the device in a vacuum. Q values for MEMS structures can be very high, up to 100,000. A Q value of about 5 should be adequate for the switch to operate, although a higher value will allow the switch to be more power efficient and have a lower operating voltage.

For the switch to work there needs to be stored elastic potential energy in the structure. This elastic potential energy needs to be introduced prior to the normal operation of the switch. This energy could be introduced by applying a very large initial "setting" voltage that exceeds the pull-in voltage of the structure. Another option, which would be slower but would allow for the initial pull-in of the structure with a voltage lower than the pull-in voltage, is to apply a voltage signal to the electrodes that is modulated at the resonant frequency of the structure. As long as the energy being input with each cycle is more than that being dissipated through damping, the structure will increase its amplitude of oscillation until it is close enough to the electrode to be pulled-in by the lower voltage.

The standard methods to provide switching actuation for micro-mechanical switches are electrostatic, piezoelectric, thermal (with a bi-material structure or shape memory materials), or magnetic. Thermal and magnetic actuation requires a significant current to flow for the actuation to take place. This leads to much higher energy consumption per switch cycle than electrostatic and piezoelectric switches, which have very low current. The electrostatic and piezoelectric switches still have some energy consumption since elastic potential energy is stored in the structure every time a voltage is applied. This energy is then dissipated when the switch is turned off (or released). The inventive switch should require less energy per switch operation than any of the current MEMS switches, since the energy for the actuation comes predominantly from the stored elastic potential energy. Very little of this energy is dissipated with each switch cycle. The small amount of dissipated energy is replaced by a small amount of energy injected due to the electrostatic hold voltage. This lower energy requirement should lead to a switch that requires less power to operate (for switches with comparable switching speeds).

The voltage requirements for all of these switches vary significantly from ~3V to 100V and higher. Depending on the application, variations of the switch described herein could have actuation voltages anywhere within this range. For a given set of switch characteristics (switching speed, size, power, restoring force, etc.) the switch being disclosed here should, in general, require a lower voltage than most other actuation techniques.

One of the particular areas where the switch being described here provides significant improvement is switching speeds. Currently, the fastest mechanical switches use electrostatic actuation. This type of switch has a limiting speed of approximately 1 μs. The switch described here should allow significant improvement of the switching speed. A ten times or greater improvement could reasonably be achieved. Much of this depends on the application and the required size of the switch but for a given application, this switch should offer significant improvements in switching speeds over all other mechanical switching technologies.

The reliability of the switch disclosed here may also prove to be better than that of other approaches. One of the most significant failure mechanisms of micro-switches is stiction of the electrodes. Stiction occurs when the surface adhesion force between the two faces of the contacting materials is higher than the restoring force of the structure so the surfaces are unable to separate when the switch is turn off. Surface adhesion forces can evolve over the lifetime of the switch such that the switch may fail by stiction after performing well for a number of cycles. The switch described here provides a much higher restoring force than other switch technologies, which means the switch should be much less affected by surface adhesion forces. This should result in improved reliability.

Applications for this type of micro-switch include switching for optical networks, RF circuits, and low frequency circuits. Optical switching could be accomplished by interacting with the evanescent field of a waveguide or set of waveguides to produce switching functionality in the network. For example, an optically lossy material could be moved into or out of the evanescent field of an optical ring resonator filter to switch the resonance of the ring resonator off and on which would allow the resonant wavelength to be either dropped or passed through the filter. Several other optical switch implementations are also conceivable. The switching for RF circuits could follow the two standard techniques of using either capacitance switching or metal to metal contact switching. This type of switch is usually referred to as an RF MEMS switch. The switching for low frequency circuits could be done with a metal to metal contact switch, much like the RF switch approach. This kind of switch is sometimes called a micro-mechanical relay. In addition to these more well known switching applications, there are very likely many other applications where this type of switch would be useful.

Figure 6A:
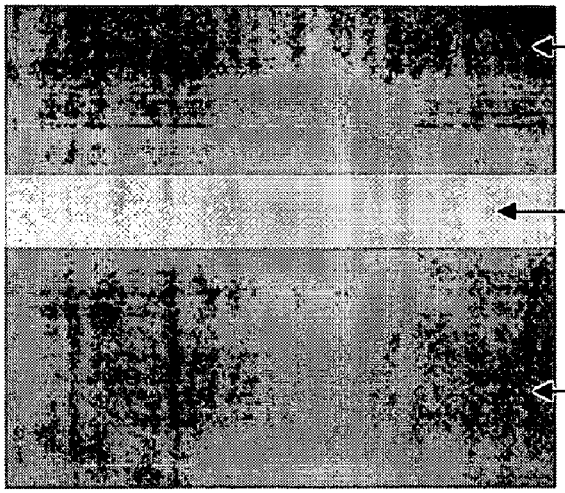
FIGS. 6A-6G are schematic diagrams illustrating one possible approach to fabricating a micro-switch device that uses the inventive switching technique.
Figure 6B:
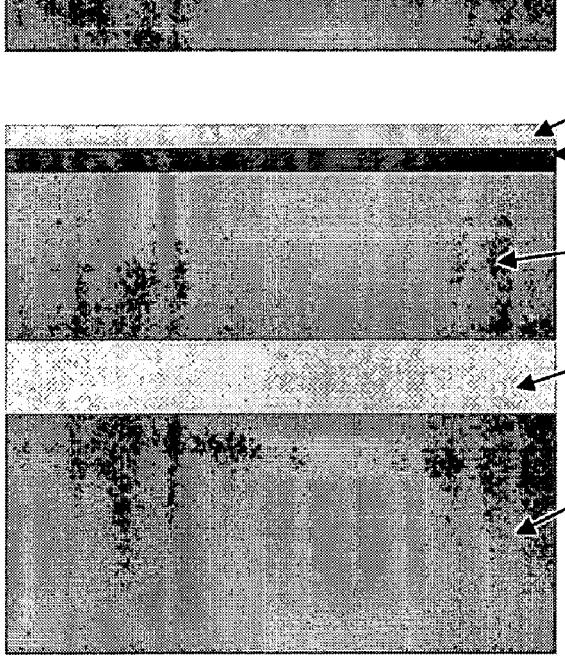
Figure 6C:
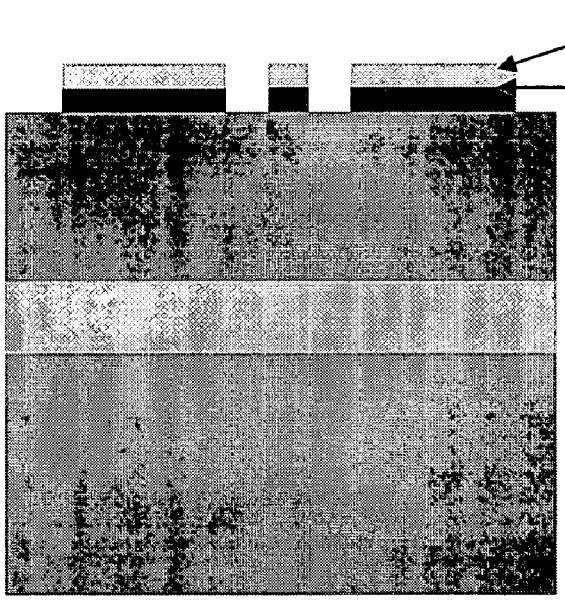
Figure 6D:
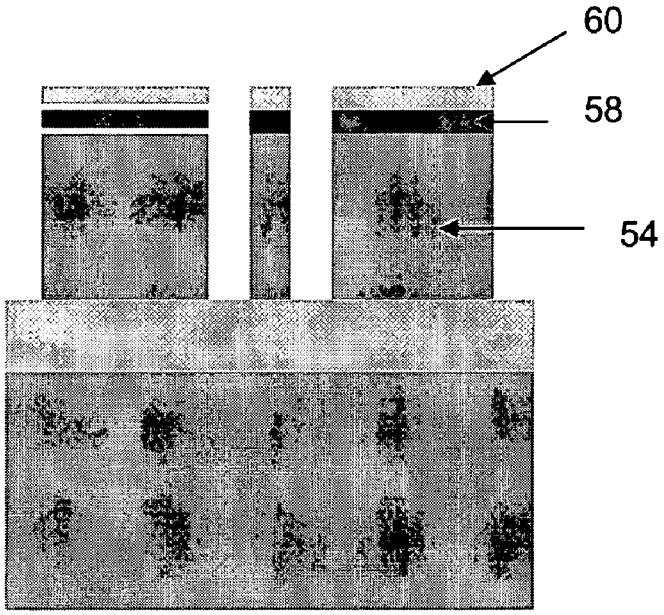
Figure 6E:
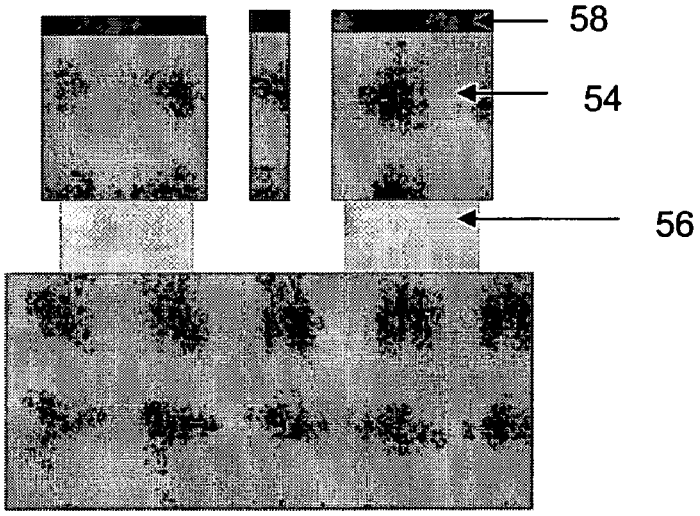
Figure 6F:
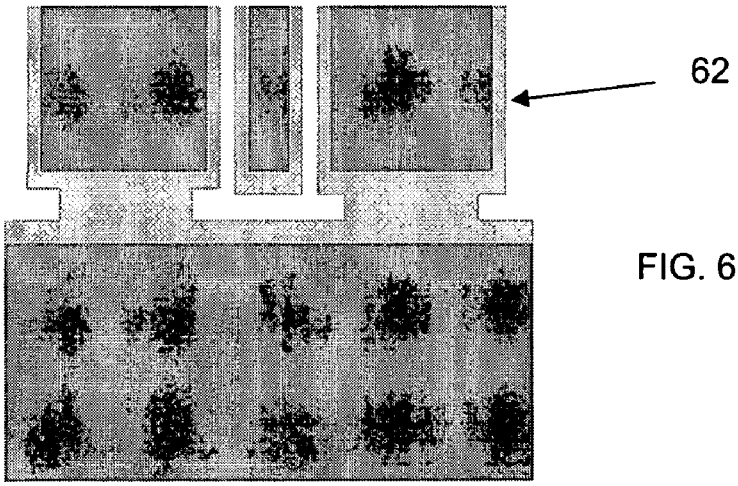
Figure 6G:
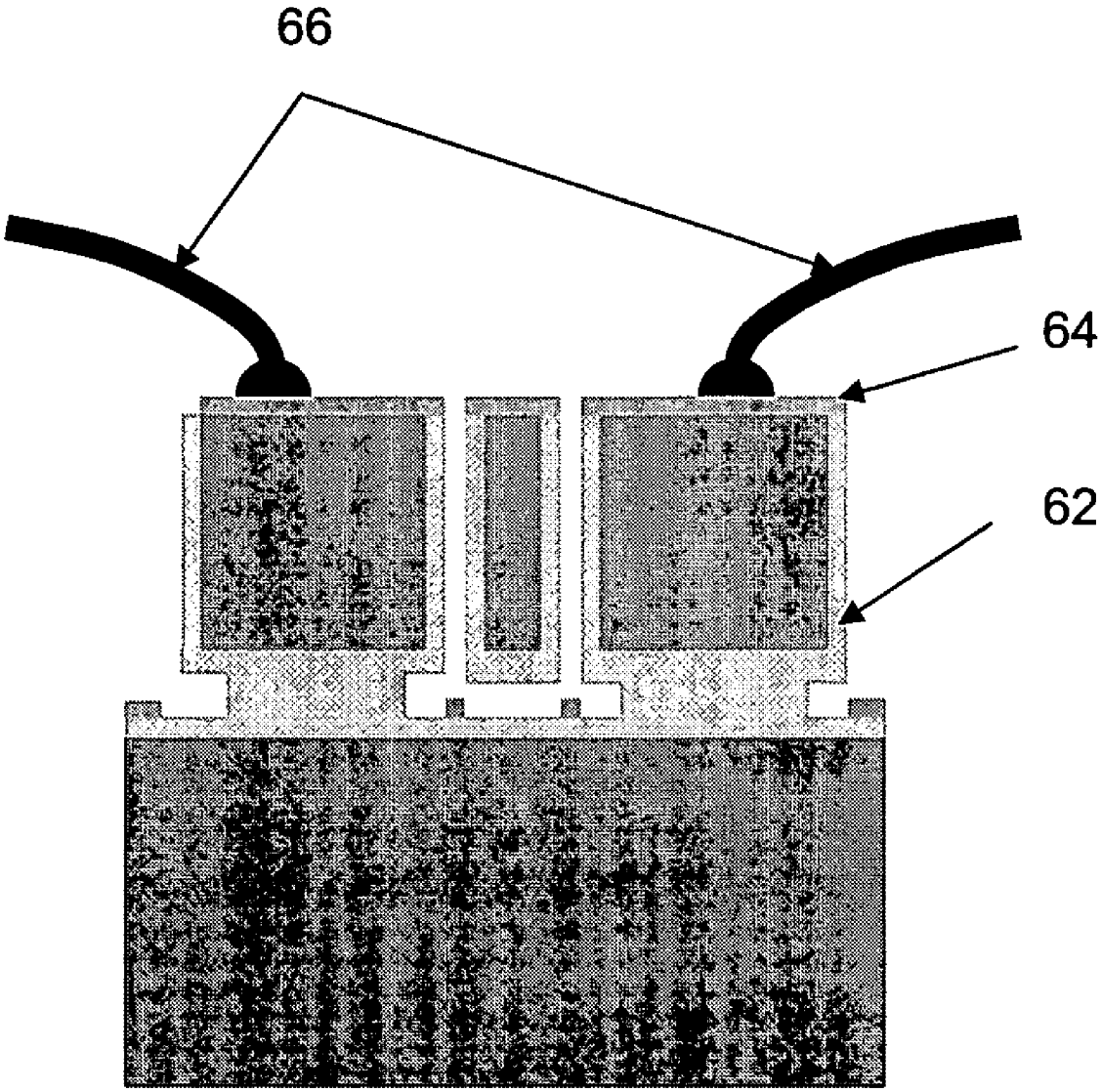

FIGS. 6A-6F shows one possible approach to fabricating a micro-switch device that uses the switching technique described herein. The technique uses an SOI wafer 50 and makes use of the silicon device layer 54 and oxide layer 56, as shown in FIG. 6A, to form a movable electrode as well as the two fixed electrodes. The silicon handle layer 52 acts as a substrate for the switching structure to be anchored to. In this particular implementation, the movable electrode would move side to side rather than up and down relative to the substrate. FIG. 6B shows a layer 58 of silicon nitride being deposited on the SOI wafer 50. Afterwards, an oxide layer 60 is deposited on layer 58. FIG. 6C shows layers 58, 60 being patterned using lithographic techniques and reactive ion etching (RIE). FIG. 6D shows layer 54 being etched using an RIE technique. FIG. 6E shows layer 56 being isotropically removed from underneath the movable electrode. FIG. 6F shows a layer 62 of thermal oxide being grown and the nitride layer 58 being subsequently removed. FIG. 6G shows an aluminum layer 64 being deposited to facilitate the formation of a wirebond 66.

Figure 7:
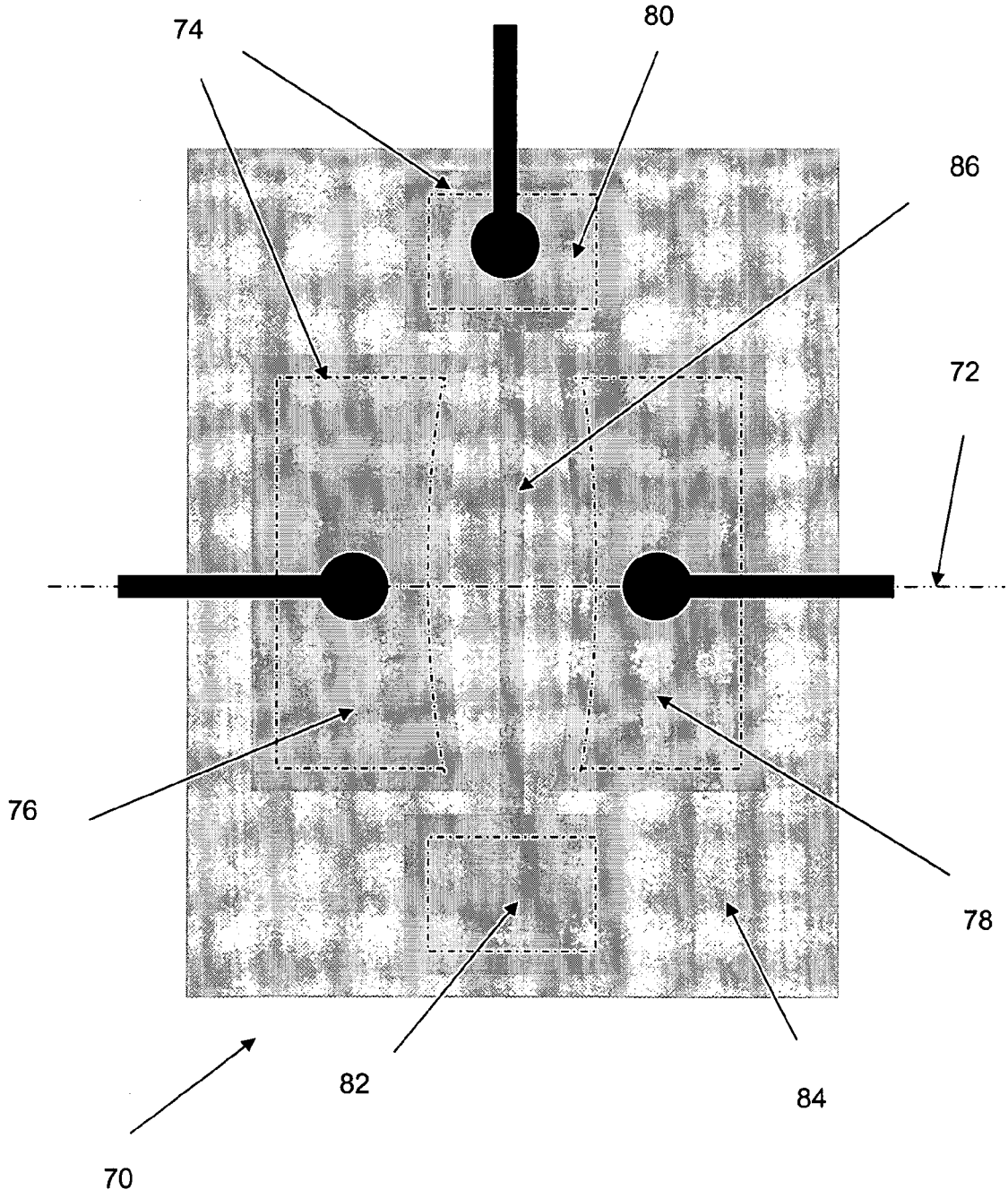
FIG. 7 is a top view of the device after the completion of the fabrication process described by FIGS. 6A-6F.

FIG. 7 shows a top view of a micro-switch device 70 after fabrication is complete. The dash-dot-dot line 72 shows the cross-section shown in the fabrication process schematics of FIG. 6. The dash-dot line 74 shows the outline of the un-etched SOI oxide layer 56 underneath the fixed electrodes 76, 78 and the anchors of the movable electrode 80, 82. The un-etched SOI oxide layer 56 anchors the structures to the substrate 84. The movable electrode 86 has all of the SOI oxide layer 56 removed from underneath it.

The use of the silicon nitride layer 58 is important in that it allows the thermal oxide to only be grown on the sides and bottom of the movable and fixed electrodes. The top of those electrodes needs to be free of oxide to allow good electrical contact with the wirebonds 66.

This fabrication technique offers several advantages. First the number of mask steps is reduced as compared with a typical up and down or torsional switch. Also, the silicon device layer has very low, if any, residual stress and a very low dislocation density. Both characteristics add to the performance and reliability of the device. Also, silicon and silicon dioxide are used for the movable electrode structure. Both of these materials have very high failure strengths, allowing for very fast switch operation. The silicon dioxide is also resistant to fatigue failure and dielectric charging, as compared to other common dielectric materials such as silicon nitride.

One last advantage is that the fixed electrodes can be curved to match the fundamental mode shape of the movable electrode. This is desirable because it should allow lower actuation voltages as well as direct the stored elastic potential energy into the lowest resonant mode of the device rather than exciting higher modes that would detract from the switching action.

Although the present invention has been shown and described with respect to several preferred embodiments thereof, various changes, omissions and additions to the form and detail thereof, may be made therein, without departing from the spirit and scope of the invention.

What is claimed is:

1. An electro-mechanical micro-switch device comprising:

a first fixed electrode;

a second fixed electrode; and a movable electrode, supported by a support structure, positioned with respect to the first and second electrodes so that the position of the movable electrode can be selectively placed in one of two opposing states defined by the first and second electrodes under application of a voltage with respect to at least one of the first and second electrodes, a pull-in voltage being defined for the device, wherein the movable electrode and the support structure are part of a flexible structure and wherein elastic potential energy stored in the flexible structure is used for switching between said two states so that the movable electrode can switch from being pulled-in to the first fixed electrode to being pulled-in to the second fixed electrode under application of a first voltage lower than the pull-in voltage, and from being pulled-in to the second fixed electrode to being pulled-in to the first fixed electrode under application of a second voltage lower than the pull-in voltage.

2. The electro-mechanical micro-switch device of claim 1, wherein the applied voltage is in the range of less than 5% of the pull-in voltage of the device up to 90% of the pull-in voltage of the device.

3. The electro-mechanical micro-switch device of claim 1, wherein the Q of the device is greater than or equal to about 5.

4. The electro-mechanical micro-switch device of claim 1, wherein the device is packaged in a vacuum.

5. The electro-mechanical micro-switch device of claim 1, wherein said movable electrode displaces rectilinearly.

6. The electro-mechanical micro-switch device of claim 1, wherein said movable electrode is suspended by a torsional spring and displaces rotationally.

7. The electro-mechanical micro-switch device of claim 1, wherein said first and second fixed electrodes provide a switching trigger due to applied first and second voltages to cause the structure to alternate between the two opposing states.

8. The electro-mechanical micro-switch device of claim 1, wherein said first and said second electrodes are shaped to match a mode shape of the movable electrode.

* * * * *